US008968008B2

(12) United States Patent
Chang

(10) Patent No.: US 8,968,008 B2
(45) Date of Patent: Mar. 3, 2015

(54) UNIVERSAL CIRCUIT BOARD MODULE AND ELECTRIC CONNECTOR USING THE SAME

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 21 days.

(21) Appl. No.: 13/890,669

(22) Filed: May 9, 2013

(65) Prior Publication Data

US 2013/0309879 A1 Nov. 21, 2013

(30) Foreign Application Priority Data

May 17, 2012 (TW) ..... 101209358 A

(51) Int. Cl.

| | |
|---|---|
| ***H01R 12/00*** | (2006.01) |
| ***H01R 12/52*** | (2011.01) |
| ***H01R 12/73*** | (2011.01) |
| ***H01R 13/66*** | (2006.01) |

(52) U.S. Cl.

CPC ..... *H01R 12/52* (2013.01); *H01R 12/73* (2013.01); *H01R 13/6658* (2013.01)

USPC ..... 439/74

(58) Field of Classification Search

USPC ..... 439/74, 79, 701, 541.5, 752, 567, 248, 439/78, 83

See application file for complete search history.

(56) References Cited

U.S. PATENT DOCUMENTS

| | | | | |
|---|---|---|---|---|
| 6,296,518 | B1 * | 10/2001 | Avery et al. | 439/541.5 |
| 6,558,191 | B2 * | 5/2003 | Bright et al. | 439/541.5 |
| 6,661,671 | B1 * | 12/2003 | Franke et al. | 361/752 |
| 6,764,349 | B2 * | 7/2004 | Provencher et al. | 439/701 |
| 6,979,215 | B2 * | 12/2005 | Avery et al. | 439/248 |
| 7,217,151 | B2 * | 5/2007 | Geibel et al. | 439/449 |
| 7,320,609 | B1 * | 1/2008 | Minich | 439/79 |
| 7,672,141 | B2 * | 3/2010 | Middleton et al. | 361/785 |
| 8,197,262 | B2 * | 6/2012 | Nguyen et al. | 439/74 |

* cited by examiner

*Primary Examiner* — Jean F Duverne

(74) *Attorney, Agent, or Firm* — Muncy, Geissler, Olds & Lowe, P.C.

(57) ABSTRACT

The present invention discloses a universal circuit board module and an electric connector using the same. The electric connector includes a housing and a universal circuit board module. The housing includes an electric connecter with a plurality of connecting ports and a recess. The recess is used for assembling the universal circuit board module. The electric connector is expanded by increasing the universal circuit board module having electric connecting head with demanded standard or particular function, such that the expansibility can be enhanced.

19 Claims, 8 Drawing Sheets

UNIVERSAL CIRCUIT BOARD MODULE AND ELECTRIC CONNECTOR USING THE SAME

BACKGROUND OF THE INVENTION

1. Field of the Invention

The present invention relates to an electric connector, and in particular to a universal electric connector.

2. Description of Related Art

As technology develops, more and more peripheral equipment of computer are manufactured. In order to make the computer to be electrically connected to the peripheral equipment, a plurality of electric connectors with different standards must be installed on a mother board of the computer, such that the peripheral equipment can be electrically connected to the computer via transmission lines, whereby controlling signals or data outputted by the computer can be transmitted to the peripheral equipment or the data provided by the peripheral equipment can be transmitted to the computer.

In recently, the volume of the computer is manufactured towards miniaturization due to electric device is designed to be lightweight, thin and compact, such that the volume of mother boards installed within the computers must be minimized. It is an important issue to install connecting ports with different standards within a motherboard having limited space when the volume of the mother board is minimized.

Some manufactures makes an electric connector with multiple connecting ports (such as universal series bus (USB) connecting port, high-definition multimedia interface (HDMI) connecting port, displayport connecting port, personal system/2 (PS/2) connecting port, external serial advanced technology attachment (eSATA) connecting port, micro USB connecting port, mini USB connecting port, or IEEE 1394 connecting port) by stacking the connecting ports in a housing, such that the electric connector with multiple connecting port can be used under limited space of the motherboard. However, the housing for installing the connecting ports has fixed standard and profile, such that the housing must be redesigned when an additional connecting port with the same standard as one of the original connecting ports or with differed standard from the original connecting ports is expanded in the electric connector.

SUMMARY OF THE INVENTION

It is an object to provide a universal circuit board module, the universal circuit board module is assembled with an electric connector having a plurality of connecting ports, such that the electric connector can be expanded and include an electric connector having demanded standard or particular function. Therefore, the expansibility of the electric connector having the connecting ports is enhanced with easily manufacture and low cost.

Accordingly, the universal circuit board module comprises an expansion unit and a conversion unit. The expansion unit comprises a circuit board. A first electric connector is disposed on one surface of the circuit board. The conversion unit comprises a circuit substrate. The circuit substrate is electrically connected to a second electric connector assembled with the first electric connector and a plurality of electrically conductive terminals disposed on one surface of the circuit substrate.

In an embodiment of the present invention, wherein the circuit board is electrically connected to an electric connecting head disposed on another surface of the circuit board.

In an embodiment of the present invention, wherein the electric connecting head is one of universal series bus (USB) electric connecting head, high-definition multimedia interface (HDMI) electric connecting head, displayport electric connecting head, personal system/2 (PS/2) electric connecting head, external serial advanced technology attachment (eSATA) electric connecting head, micro USB electric connecting head, mini USB electric connecting head, and IEEE 1394 electric connecting head.

In an embodiment of the present invention, wherein the circuit board is electrically connected to a signal processor disposed thereon.

In an embodiment of the present invention, wherein the signal processor is a signal converting integrated circuit (IC) or driving IC.

In an embodiment of the present invention, wherein the circuit substrate is electrically connected to a signal processor disposed thereon.

In an embodiment of the present invention, wherein the signal processor is a signal converting integrated circuit (IC) or driving IC.

In an embodiment of the present invention, the universal circuit board module further comprising a shell, the expansion unit and the conversion unit are encapsulating within the shell, and the electrically conductive terminals extend out of the shell.

Accordingly, the electric connector comprises a housing and a universal circuit board module. The universal circuit board module comprises a conversion unit comprising a circuit substrate. The circuit substrate is electrically connected to a second electric connector and a plurality of electrically conductive terminals disposed on a surface of the circuit substrate.

In an embodiment of the present invention, the electric connector further comprises a metallic shell covering an exterior of the housing is cover by a metallic shell, at least one connecting port is assembled within the housing, wherein the housing includes a recess disposed thereon for assembling the universal circuit board module therein, the recess includes a plurality of through holes for the electrically conductive terminals threaded therein, and the housing comprises positioning portions of barb shape on lateral sides of the recess.

In an embodiment of the present invention, wherein the connecting port is one of USB connecting port, HDMI connecting port, displayport connecting port, PS/2 connecting port, eSATA connecting port, micro USB connecting port, mini USB connecting port, and IEEE 1394 connecting port.

In an embodiment of the present invention, wherein the universal circuit board module further comprises an expansion unit comprising a circuit board and a first electric connector disposed on a surface of the circuit board, the first electric connector is assembled with and electrically connected to the second electric connector.

In an embodiment of the present invention, wherein the circuit board is electrically connected to an electric connecting head disposed on a surface of the circuit board.

In an embodiment of the present invention, wherein the electric connecting head is one of USB electric connecting head, HDMI electric connecting head, displayport electric connecting head, PS/2 electric connecting head, eSATA electric connecting head, micro USB electric connecting head, mini USB electric connecting head, and IEEE 1394 electric connecting head.

In an embodiment of the present invention, wherein the circuit board is electrically connected to a signal processor disposed thereon.

In an embodiment of the present invention, wherein the signal processor is a signal converting IC or driving IC.

In an embodiment of the present invention, wherein the circuit substrate is electrically connected to a signal processor disposed thereon.

In an embodiment of the present invention, wherein the signal processor is a signal converting IC or driving IC.

In an embodiment of the present invention, wherein the universal circuit board module further comprises a shell, the expansion unit and the conversion unit are encapsulated within the shell, and the electrically conductive terminals extend out of the shell.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 1:
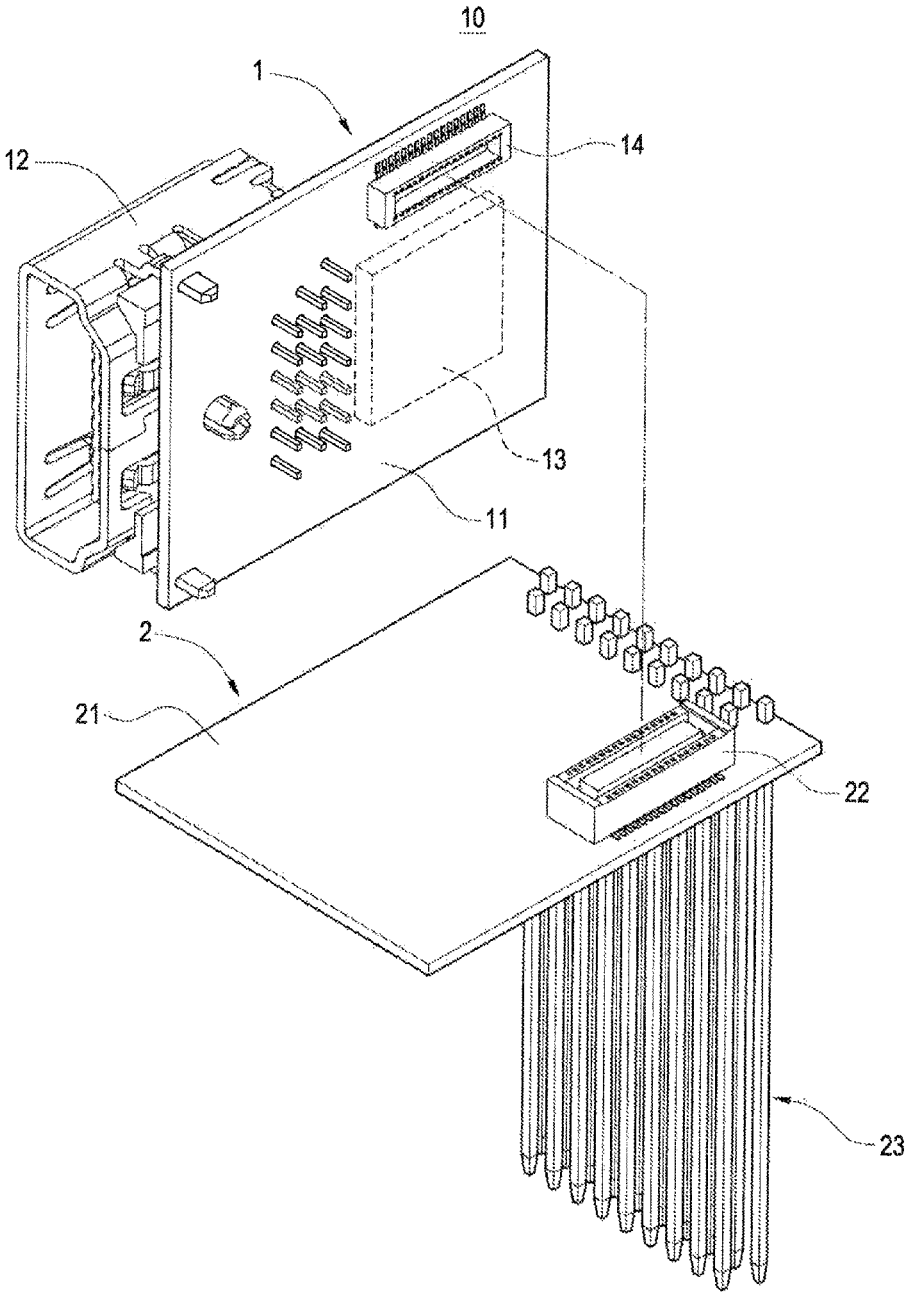
FIG. 1 is an exploded view of a universal circuit board module according to a first embodiment of the present invention.
Figure 2:
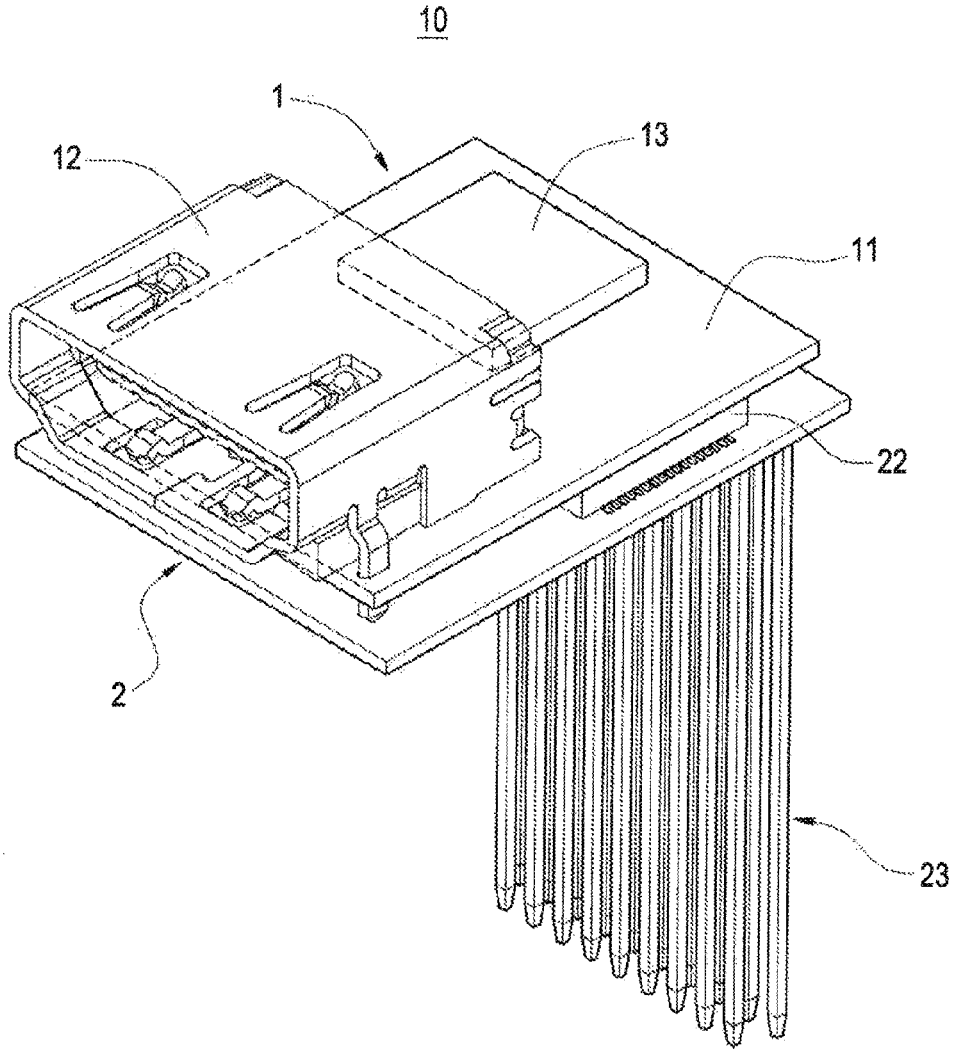
FIG. 2 is a perspective view of the assembled universal circuit board module according to the first embodiment of the present invention.
Figure 3:
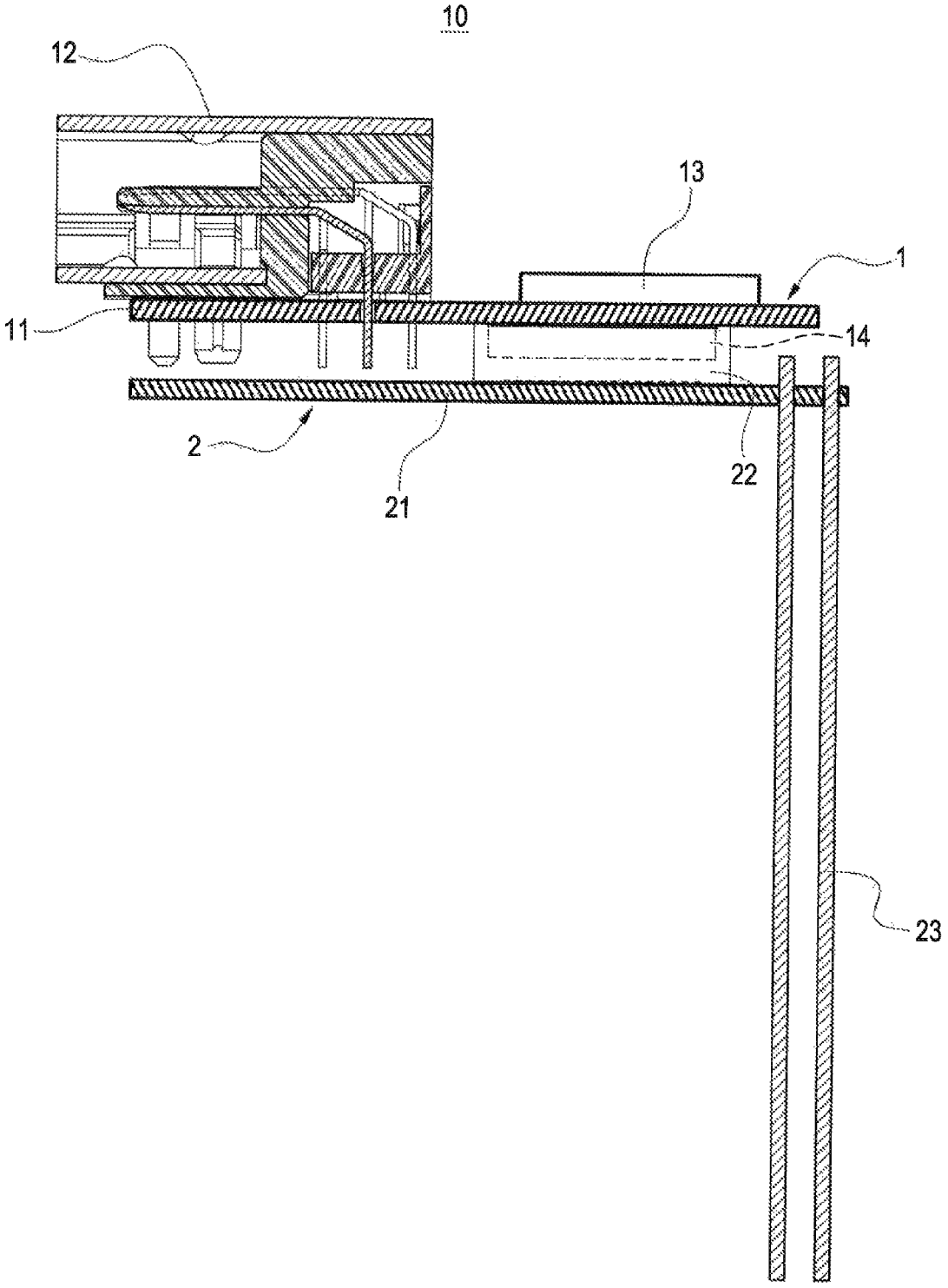
FIG. 3 is a sectional view of the universal circuit board module according to the first embodiment of the present invention.

Referred is made to FIG. 1, FIG. 2, and FIG. 3, FIG. 1 is an exploded view of a universal circuit board module according to a first embodiment of the present invention, FIG. 2 is a perspective view of the assembled universal circuit board module according to the first embodiment of the present invention, and FIG. 3 is a sectional view of the universal circuit board module according to the first embodiment of the present invention. The universal circuit board module 10 includes an expansion unit 1 and a conversion unit 2.

The expansion unit 1 includes a circuit board 11, an electric connecting head (such as an electric socket) 12, a signal processor 13 of the electric connecting head 12, and a first electric connector 14. The electric connecting head 12 and the signal processor 13 are respectively disposed on an upper surface of the circuit board 11 and electrically connected to the circuit board 11. The first electric connector 14 is disposed on a lower surface of the circuit board 11 and used for electrically connecting to the conversion unit 2. In particularly, the lower surface is opposite to the upper surface. The electric connecting head 12 is one of universal serial bus (USB) connecting head, high-definition multimedia interface (HDMI) connecting head, displayport connecting head, personal system/2 (PS/2) connecting head, external serial advanced technology attachment (eSATA) connecting head, micro USB connecting head, mini USB connecting head, and IEEE 1394 connecting head.

The conversion unit 2 includes a circuit substrate 21, a second electric connector 22, and a plurality of electrically conductive terminals 23. The second electric connector 22 is disposed on an upper surface of the circuit substrate 21 and electrically connected to the circuit substrate 21. The second electric connector 22 is assembled with the first electric connector 14 disposed on the circuit board 11. The electrically conductive terminals 23 are disposed on a lower surface of the circuit substrate 21 and electrically connected to the circuit substrate 21. In particularly, the lower surface is opposite to the lower surface. The electrically conductive terminals 23 are used for transmitting signals.

With reference again to FIG. 2 and FIG. 3, the first electric connector 14 disposed on the circuit board 11 of the expansion unit 1 is assembled with the second electric connector 22 disposed on the circuit substrate 21 of the conversion unit 2, such that the first electric connector 14 is electrically connected to the second electric connector 22. The electric connecting head 12 disposed on the upper surface of the circuit board 11 can be a transmitting line (not shown) of one of USB connector, HDMI connector, displayport connector; PS/2 connector, eSATA connector, micro USB, mini USB, and IEEE 1394 connector. A signal transmitted to the expansion unit 1 via the transmitting line is processed by the signal processor 13 disposed on the circuit board 11, and then a processed signal is outputted by the signal processor 13 and transmitted to the second electric connector 22 via the first electric connector 14 assembled with the second electric connector 22. After that, the processed signal is transmitted to a mother board (not shown) of an electrical device (not shown) via the electrically conductive terminals 23 disposed on the lower surface of the circuit substrate 21.

On the other hand, a signal processed by the mother board is transmitted to the circuit substrate 21 via the electrically conductive terminals 23. The signal is then transmitted to the first electric connector 14 via the second electric connector 22 assembled with the first electric connector 14. The signal processor 13 processes the signal and outputs a processed signal to the electric connecting head 12. The electric connecting head 12 transmits the processed signal to the transmitting line to achieve signal transmission.

In another embodiment of the present invention, the signal processor 13 can be disposed on the circuit substrate 21 and electrically connected thereto.

Figure 4:
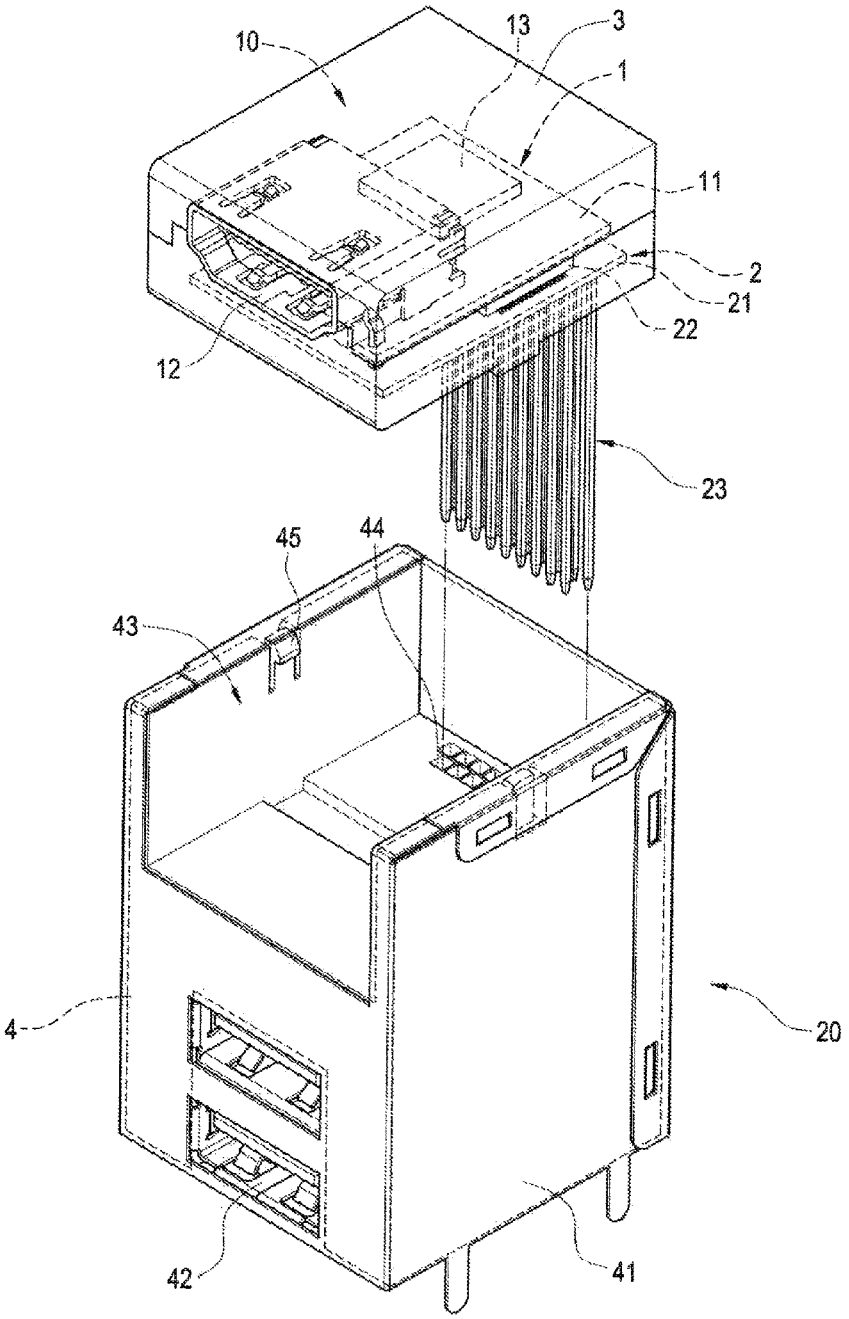
FIG. 4 is an exploded view of an electric connector according to a first embodiment of the present invention.
Figure 5:
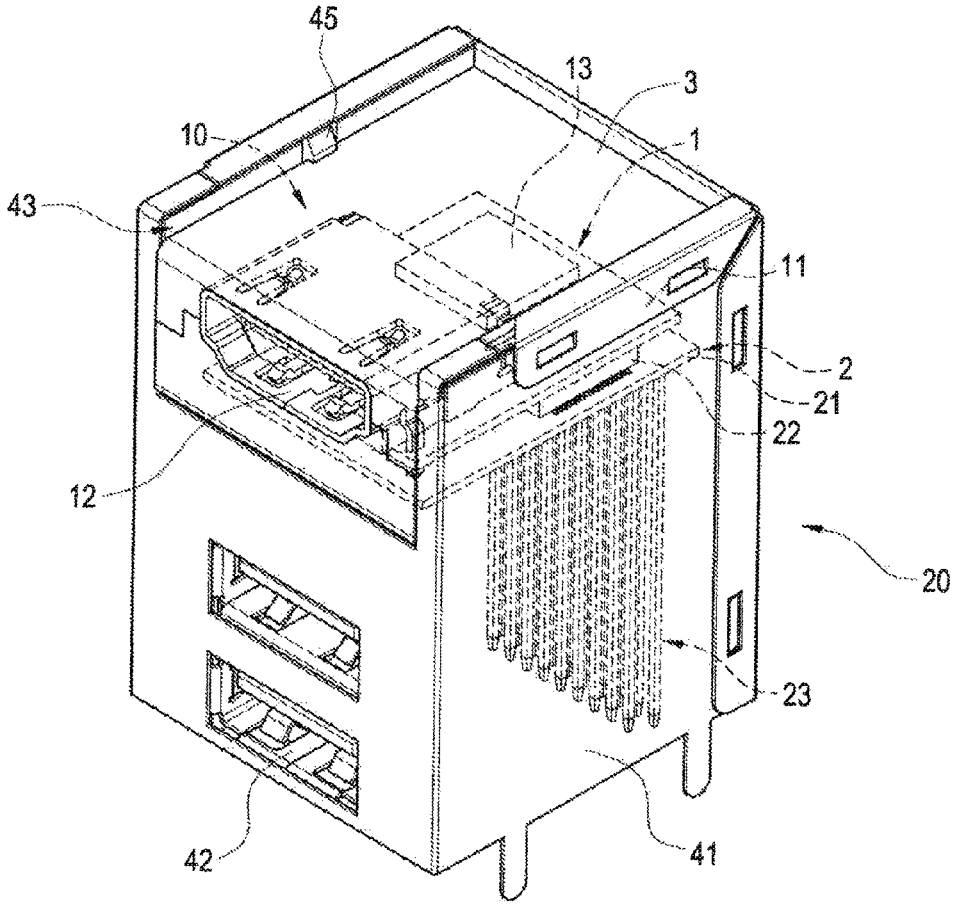
FIG. 5 is a perspective view of the assembled electric connector according to the first embodiment of the present invention.
Figure 6:
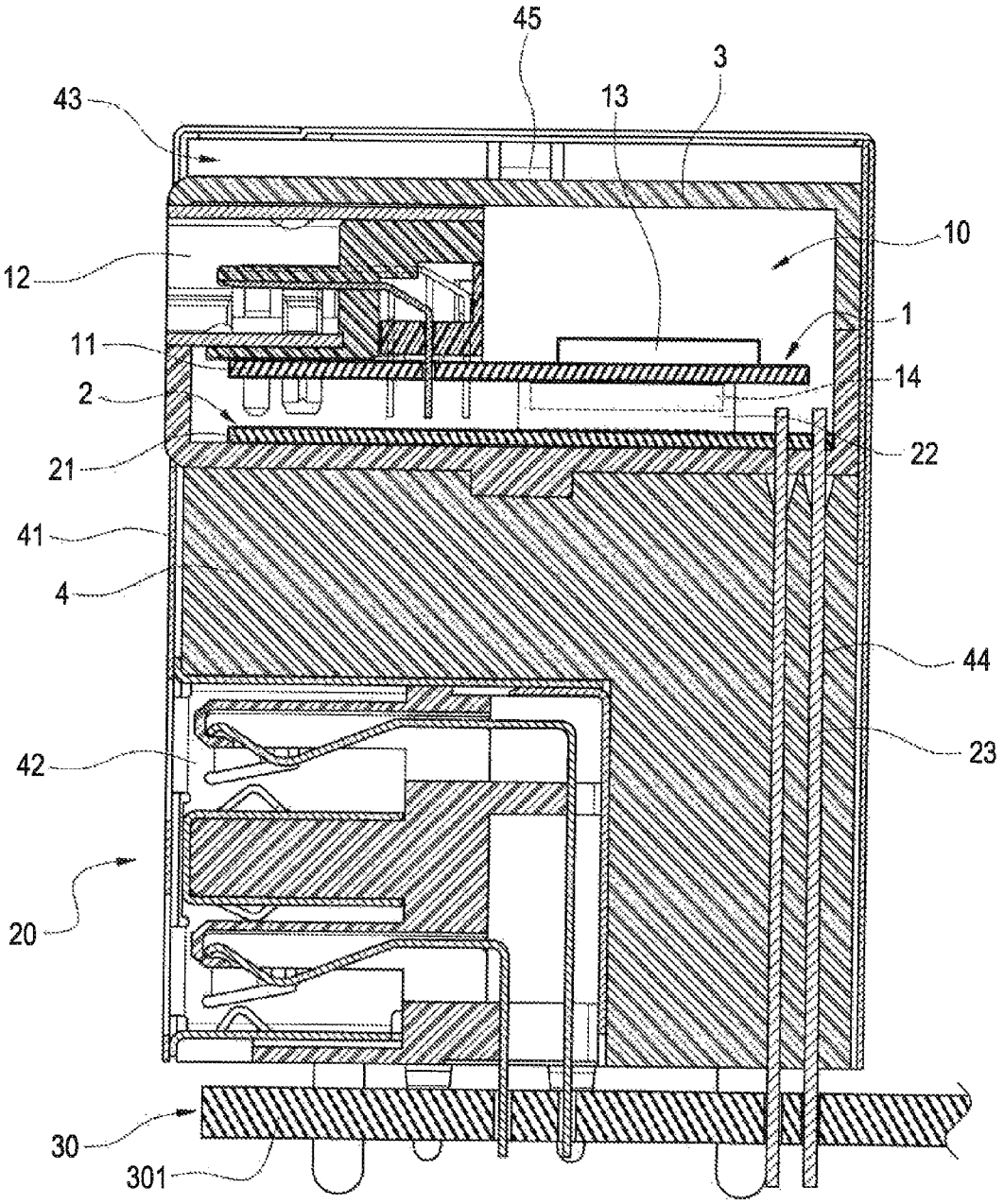
FIG. 6 is a sectional view of the electric connector according to the first embodiment of the present invention.

Referred is made to FIG. 4, FIG. 5, and FIG. 6, FIG. 4 is an exploded view of an electric connector according to a first embodiment of the present invention, FIG. 5 is a perspective view of the assembled electric connector according to the first embodiment of the present invention, and FIG. 6 is a sectional view of the electric connector according to the first embodiment of the present invention. When the universal circuit board module 10 is completely assembled, the assembled universal circuit board module 10 is encapsulated within a shell 3, and the electrically conductive terminals 23 extend out of the shell 3. After that, the assembled universal circuit board module 10 with the shell 3 is then assembled with an electric connector 20.

The electric connector 20 includes a housing 4. The electric connector further includes a metallic shell 41 covers an exterior of the housing 4. At least one connecting port 42 for inserting at least one signal transmitting line is assembled within the housing 4. The housing 4 further includes a recess 43 for assembling the universal circuit board module 10. The recess 43 includes a plurality of through holes 33 penetrated the housing 4. The electrically conductive terminals 23 respectively thread through the through holes 33, and a rear end of each electrically conductive terminal 23 is exposed to the housing 4. The housing 4 includes positioning portions 45 of barb shape on lateral sides of the recess 43. The positioning portions 45 are used for fastening the universal circuit board module 10 within the recess 43. In this embodiment, the connecting port 42 is one of USB connecting port, HDMI connecting port, displayport connecting port, PS/2 connecting port, eSATA connecting port, micro USB connecting port, mini USB connecting port, and IEEE 1394 connecting port. After assembling the universal circuit board 10 in the electric connector 20, the electric connector 20 is then disposed on and electrically connected to a mother board 301 of an electronic device 30. Not only the electric connector 20 but the electric connecting head 12 of the universal circuit board module 10 are used for the signal transmitting line inserted therein, and signal transmission is then be proceeded between the electronic device 30 and external peripheral electronic equipment.

Figure 7:
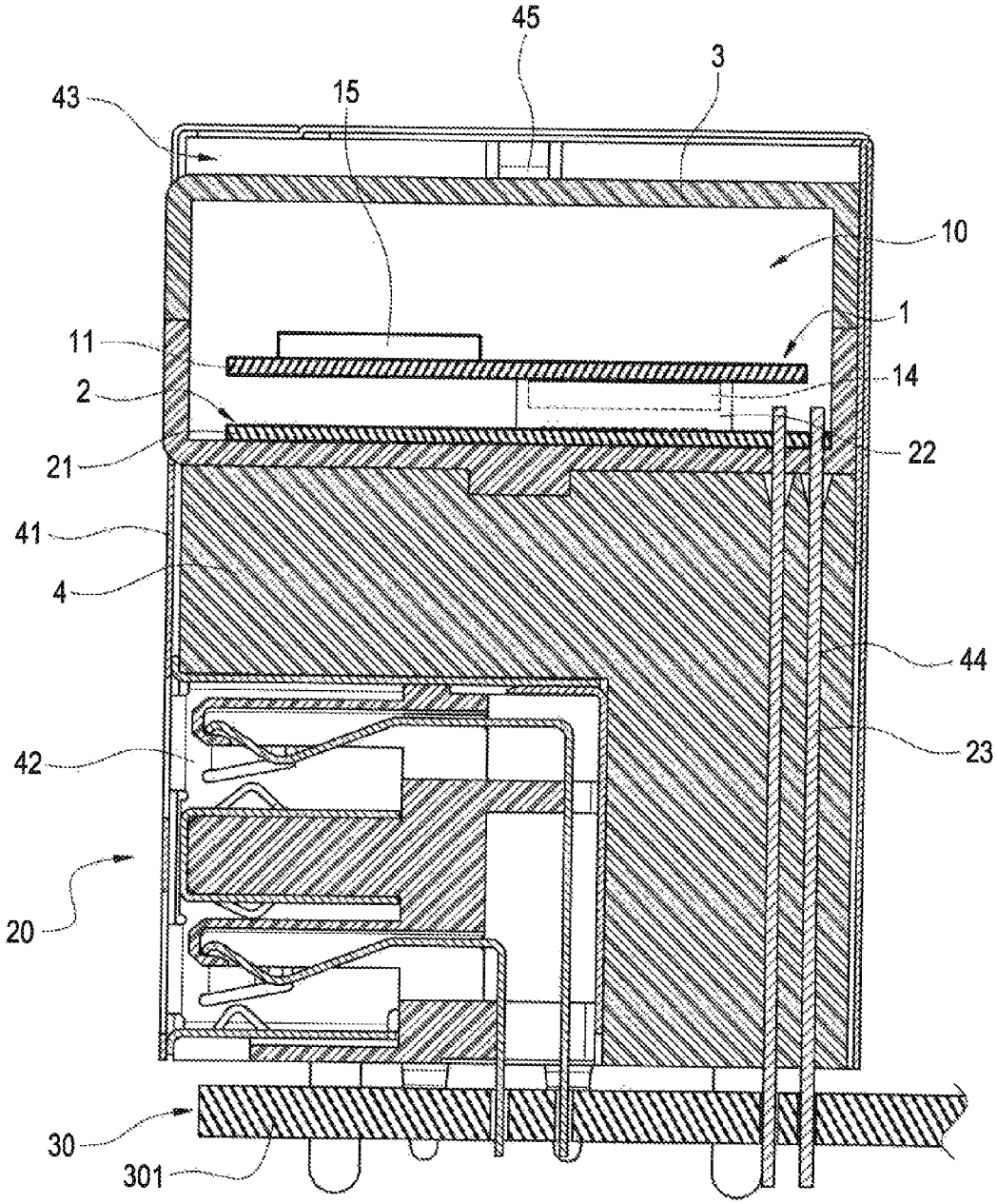
FIG. 7 is a sectional view of an electric connector according to a second embodiment of the present invention.

Referenced is made to FIG. 7, which is a sectional view of an electric connector according to a second embodiment of the present invention. In FIG. 7, a storage unit 15 is used for instead of the signal processor 13 disposed on the upper surface of the circuit board 11 of the expansion unit 1 mentioned in the first embodiment. The storage unit 15 is solid state disk (or called solid state drive). A signal transmitted from the mother board 301 of the electronic device 30 is received by the electrically conductive terminals 23 and stored in the storage unit 15 when the first electric connector 14 disposed on the circuit board 11 is electrically connected to the second electric connector 22 of the conversion unit 2.

Figure 8:
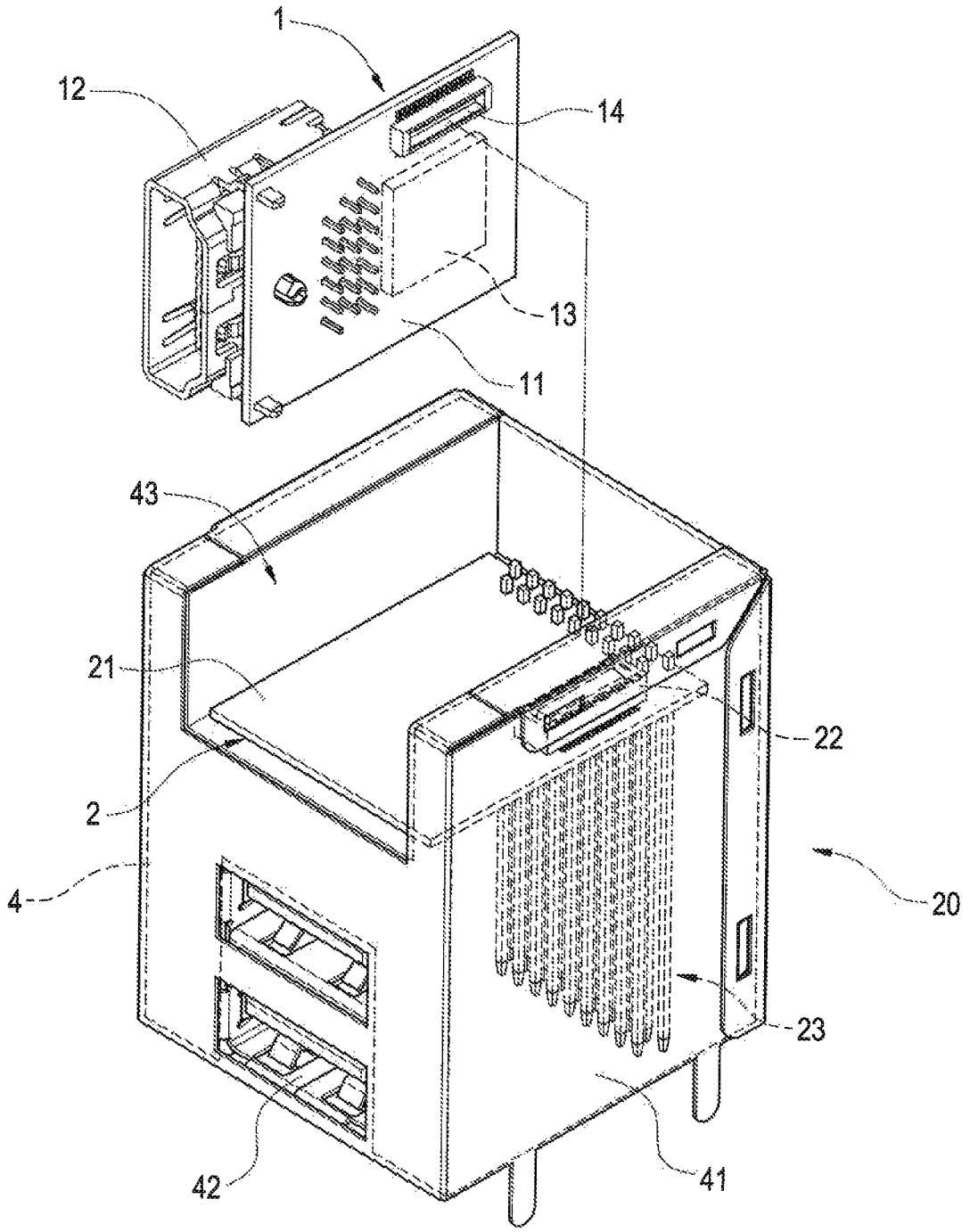
FIG. 8 is an exploded view of an electric connector according to a third embodiment of the present invention.

Referred is made to FIG. 8, which is an exploded view of an electric connector according to a third embodiment of the present invention. In this embodiment, the conversion unit 2 is directly assembled in the recess 43 formed on the housing 4 of the electric connector 20, such that user or manufacturer can assemble an expansion unit 1 with demanded standard in the recess 43 to enhance expansibility of the electric connector 20.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A universal circuit board module comprising:

an expansion unit comprising a circuit board having a first face and a second face opposite to the first face, a first electric connector disposed on the first surface of the circuit board, and a signal processor arranged on the second face of the circuit board and electrically connected to the first electric connector; and a conversion unit comprising a circuit substrate, a second electric connector electrically connected to the circuit substrate and assembled with the first electric connector, and a plurality of electrically conductive terminals disposed on one surface of circuit substrate, the conductive terminals being apart from the second electric connector and extended from the circuit substrate along a direction vertically to the circuit substrate and opposite to the circuit board.

2. The universal circuit board module in claim 1, wherein the circuit board is electrically connected to an electric connecting head disposed on another surface of the circuit board.

3. The universal circuit board module in claim 2, wherein the electric connecting head is one of universal series bus (USB) electric connecting head, high-definition multimedia interface (HDMI) electric connecting head, displayport electric connecting head, personal system/2 (PS/2) electric connecting head, external serial advanced technology attachment (eSATA) electric connecting head, micro USB electric connecting head, mini USB electric connecting head, and IEEE 1394 electric connecting head.

4. The universal circuit board module in claim 1, wherein the circuit board is electrically connected to the signal processor disposed thereon.

5. The universal circuit board in claim 1, wherein the signal processor is a signal converting integrated circuit (IC) or driving IC.

6. The universal circuit board module in claim 1, wherein the circuit substrate is electrically connected to the signal processor.

7. The universal circuit board module in claim 6, wherein the signal processor is a signal converting IC or driving IC.

8. The universal circuit board module in claim 5, further comprising a shell, the expansion unit and the conversion unit are encapsulating within the shell, and the electrically conductive terminals extend out of the shell.

9. An electric connector comprising:

a universal circuit board module comprising:

a conversion unit comprising a circuit substrate, the circuit substrate electrically connected to a second electric connector and a plurality of electrically conductive terminals disposed on a surface of the circuit substrate, the conductive terminals being apart from the second electric connector and extended from the circuit substrate along a direction vertically to the circuit substrate; and a housing comprising a recess disposed thereon for assembling the universal circuit board module therein, the recess includes a plurality of through holes for the electrically conductive terminals threaded therein.

10. The electric connector in claim 9, further comprising a metallic shell covering an exterior of the housing, at least one connecting port being assembled within the housing, and the housing comprises positioning portions of barb shape on lateral sides of the recess.

11. The electric connector in claim 10, wherein the connecting port is one of USB connecting port, HDMI connecting port, displayport connecting port, PS/2 connecting port, eSATA connecting port, micro USB connecting port, mini USB connecting port, and IEEE 1394 connecting port.

12. The electric connector in claim 11, wherein the universal circuit board module further comprises an expansion unit comprising a circuit board and a first electric connector disposed on a surface of the circuit board, the first electric connector is assembled with and electrically connected to the second electric connector.

13. The electric connector in claim 12, wherein the circuit board is electrically connected to an electric connecting head disposed on a surface of the circuit board.

14. The electric connector in claim 13, wherein the electric connecting head is one of USB electric connecting head, HDMI electric connecting head, displayport electric connecting head, PS/2 electric connecting head, eSATA electric connecting head, micro USB electric connecting head, mini USB electric connecting head, and IEEE 1394 electric connecting head.

15. The electric connector in claim 14, wherein the circuit board is electrically connected to a signal processor disposed thereon.

16. The electric connector in claim 15, wherein the signal processor is a signal converting IC or driving IC.

17. The electric connector in claim 14, wherein the circuit substrate is electrically connected to a signal processor disposed thereon.

18. The electric connector in claim 17, wherein the signal processor is a signal converting IC or driving IC.

19. The electric connector in claim 16, wherein the universal circuit board module further comprises a shell, the expansion unit and the conversion unit are encapsulated within the shell, and the electrically conductive terminals extend out of the shell.

* * * * *